United States Patent [19]

Kitatani et al.

[11] Patent Number: 4,663,260

[45] Date of Patent: May 5, 1987

[54] ELECTROPHOTOGRAPHIC LIGHT-SENSITIVE MATERIAL COMPRISING ORGANIC PHOTOCONDUCTOR AND PYRYLIUM SENSITIZER

[75] Inventors: Katsuji Kitatani; Kenji Sano, both of Kanagawa, Japan

[73] Assignee: Fuji Photo Film Co., Ltd., Kanagawa, Japan

[21] Appl. No.: 903,918

[22] Filed: Sep. 5, 1986

[30] Foreign Application Priority Data

Sep. 5, 1985 [JP] Japan ..... 60-196495
Sep. 10, 1985 [JP] Japan ..... 60-200332

[51] Int. Cl.[4] ..... G03G 5/09
[52] U.S. Cl. ..... 430/83

[58] Field of Search ..... 430/83

[56] References Cited

U.S. PATENT DOCUMENTS 3,679,408 7/1972 Kryman et al. ..... 430/83

*Primary Examiner*—J. David Welsh
*Attorney, Agent, or Firm*—Sughrue, Mion, Zinn, Macpeak and Seas

[57] ABSTRACT

An electrophotographic photosensitive material is disclosed, containing (1) an organic photoconductive substance, and (2) at least one of a specific type of pyrylium compound, and, optionally (3) at least one of a specific type of amide compound. The material exhibits high sensitivity in a wavelength region of a semi-conductor laser and is stable to heat and humidity.

12 Claims, 2 Drawing Figures

ELECTROPHOTOGRAPHIC LIGHT-SENSITIVE MATERIAL COMPRISING ORGANIC PHOTOCONDUCTOR AND PYRYLIUM SENSITIZER

FIELD OF THE INVENTION

This invention relates to a highly sensitive electrophotographic photosensitive material mainly comprising an organic photoconductive substance and, more particularly, to an electrophotographic photosensitive material which shows high sensitivity in a wavelength region of a semi-conductor laser.

BACKGROUND OF THE INVENTION

Many organic compounds serving as photoconductive materials are known, and some of them have been confirmed to have considerably high photosensitivity. Under the present situation, however, it is rare to find a practical application of the organic photoconductive materials to electrophotographic materials.

Organic photoconductive materials have many excellent properties as compared with inorganic ones and are broadly applicable in the technical field of electrophotography. For example, it is possible to produce transparent electrophotographic photosensitive films, flexible electrophotographic photosensitive films or electrophotographic photosensitive films which are lightweight and easy to handle only when organic photoconductive materials are used. Further, organic photoconductive materials have many characteristic properties that can hardly be expected from the inorganic materials, such as film-forming properties required in the production of electrophotographic photosensitive materials, surface smoothness, selectivity of polarized charge when applied to an electrophotographic process, and the like.

In spite of the above-described superiority of the organic photoconductive materials in many respects, their low photosensitivities and brittleness of their coating films constitute major reasons for their poor contribution to, and limited use in, electrophotographic techniques.

Studies on organic photoconductive materials have been directed, since the beginning, to low molecular weight heterocyclic compounds, nitrogen-containing aromatic compounds, various high molecular weight aromatic compounds, and the like, and some compounds having considerably high sensitivity have been investigated. In recent years, the center of the study has been shifted to processes of sensitization in an attempt to further increase sensitivity. This is because even the organic photoconductive materials having higher sensitivity than other materials so far known do not have sensitivity high enough to be practically used as is without being subjected to sensitization. Therefore, it is always essential for practical use of the organic photoconductive material to chose the most effective sensitization method to be applied. It is no exaggeration to say that industrial values of the organic photoconductive materials depend on the degree of increase in sensitivity finally reached by the sensitization method applied.

The most commonly known methods for sensitization include addition of sensitizing dyes and addition of Lewis acids. These methods are applicable to almost all of the organic photoconductive materials. The mechanism of sensitization of the former method is based on addition of spectral absorption characteristics of the dye to the organic photoconductive material, while that of the latter method is based on manifestation of new spectral sensitivity due to the formation of a donor acceptor complex between the organic photoconductive material and the Lewis acid.

On the other hand, electrophotographic systems using semi-conductor laser beams as a light source have recently been developed widely. Semi-conductor lasers have great advantages in that they are smaller-sized and can be produced at lower cost than gas lasers, e.g., an He-Ne laser, etc. and also they can be directly modulated. However, since many of the semi-conductor lasers have their oscillation wavelengths at 750 nm or more, photosensitive materials to be used in such systems should have their main absorption at 750 nm or more and exhibit high sensitivities. To this effect, researches have been conducted on various sensitizing dyes and others that would meet these requirements. However, most organic compounds exhibiting absorption in such a longer wavelength region are generally unstable to heat or humidity, which results in problems on production and handling. Moreover, photosensitive materials prepared by using such compounds often undergo serious changes with time, ultimately losing their functions as photosensitive materials when preserved for a long period of time. Further, some compounds, though exhibiting their main absorption in such a longer wavelength region, have small extinction coefficients or low electrophotographic sensitivities. Accordingly, the present state-of-the-art is not fully satisfactory, and it has been keenly desired to develop electrophotographic photosensitive materials showing higher sensitivity and higher durability.

SUMMARY OF THE INVENTION

One object of this invention is to provide a very excellent method of sensitizing organic photoconductive materials to thereby provide an electrophotographic photosensitive material having sensitivity high enough to be applied to practical use.

Another object of this invention is to provide an electrophotographic photosensitive material having stability to heat or humidity.

A further object of this invention is to provide an electrophotographic photosensitive material which exhibits its main absorption in an oscillation wavelength region of a semi-conductor laser and has high sensitivity.

As a result of extensive and intensive investigations, it has now been found that the above objects can be achieved by an electrophotographic photosensitive material containing (1) an organic photoconductive substance, and (2) at least one of pyrylium compounds represented by formula (I) or (II), and, preferably, (3) at least one of amide compounds represented by formula (III), (IV), or (V).

Formula (I) is represented by

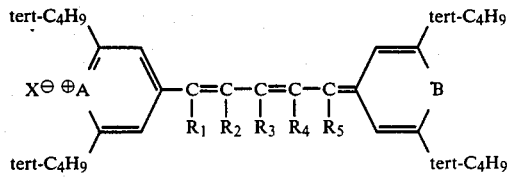

(I)

wherein $R_1$, $R_2$, $R_4$, and $R_5$ (which may be the same or different) each represents a hydrogen atom or a substituted or unsubstituted alkyl group; $R_3$ (which may be the same with or different from $R_1$, $R_2$, $R_4$, or $R_5$) represents a hydrogen atom, a halogen atom or a substituted or unsubstituted alkyl group; either one of A and B represents an oxygen atom, and the other represents a sulfur atom; and X represents an anion.

Formula (II) is represented by (II)

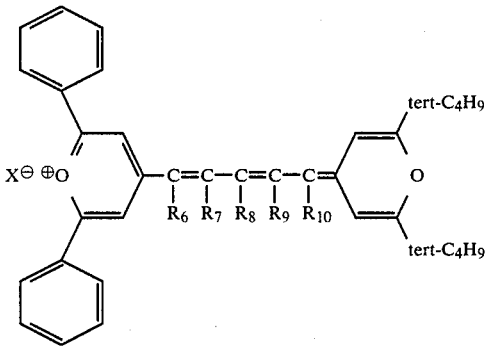

wherein $R_6$, $R_7$, $R_9$, and $R_{10}$ (which may be the same or different) each represents a hydrogen atom, a substituted or unsubstituted alkyl group, or a substituted or unsubstituted aryl group; $R_8$ (which may be the same with or different from $R_6$, $R_7$, $R_9$, or $R_{10}$) represents a hydrogen atom, a halogen atom, a substituted or unsubstituted alkyl group, or a substituted or unsubstituted aryl group; and X represents an anion.

Formulae (III), (IV), and (V) are represented by (III)

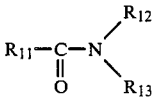

(IV)

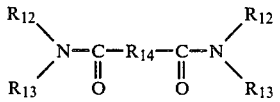

(V)

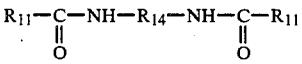

wherein $R_{11}$ represents a substituted or unsubstituted alkyl group, a substituted or unsubstituted alkoxy group, a substituted or unsubstituted monocyclic or bicyclic aryl group, a substituted or unsubstituted monocyclic or bicyclic aryloxy group, or a monovalent group derived from a substituted or unsubstituted heterocyclic ring; the two $R_{11}$ groups in formula (V) may be the same or different; $R_{12}$ and $R_{13}$ (which may be the same or different) each represents a hydrogen atom, a substituted or unsubstituted alkyl group, a substituted or unsubstituted monocyclic or bicyclic aryl group, or a monovalent group derived from a substituted or unsubstituted heterocyclic ring; $R_{14}$ represents a methylene group, a polymethylene group, a branched alkylene group, or an arylene group; and $R_{11}$ and $R_{12}$, $R_{12}$ and $R_{13}$, $R_{12}$ and $R_{14}$, $R_{13}$ and $R_{14}$, or $R_{11}$ and $R_{14}$ may be connected to each other.

DETAILED DESCRIPTION OF THE INVENTION

Figure 1:
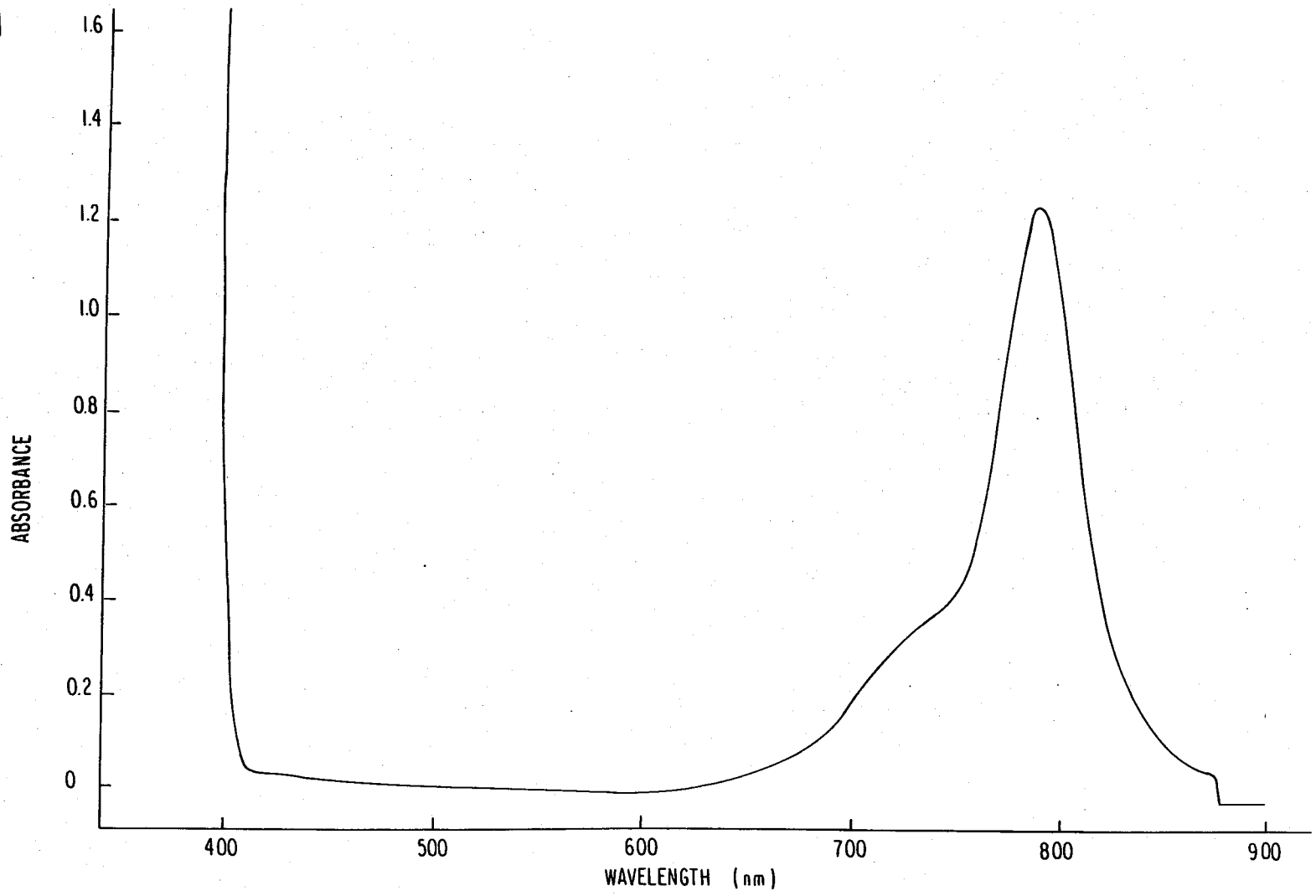
FIG. 1 shows an absorption spectrum of the electrophotographic film of Example 1 in the visible to near infrared regions.

In formulae (I) and (II), the term "alkyl group" means such group having from 1 to 18 carbon atoms, and specifically includes a methyl group, an ethyl group, an n-propyl group, an isopropyl group, an n-butyl group, a sec-butyl group, a t-butyl group, an n-amyl group, an n-hexyl group, an n-heptyl group, an n-nonyl group, an n-dodecyl group, a 2-ethylhexyl group, a fluoromethyl group, a chloromethyl group, a bromomethyl group, a trifluoromethyl group, a perfluoroalkyl group, a methoxymethyl group, a cyanomethyl group, an alkylthiomethyl group, etc.

The term "aryl group" as used in formulae (I) and (II) means such group having from 6 to 24 carbon atoms, and specifically includes a phenyl group, a tolyl group, a chlorophenyl group, a fluorophenyl group, a naphthyl group, etc.

The anion as represented by X specifically includes a perchlorate anion, a tetrafluoroborate anion, an iodide anion, a chloride anion, a bromide anion, a sulfate anion, a periodide anion, a p-toluenesulfonate anion, etc.

The pyrylium compounds represented by formula (I) can be obtained by, for example, reacting a 2,6-di-t-butyl-4-methylthiapyrylium salt as disclosed in U.S. Pat. No. 4,343,948 with an equimolar amount of 1-anilino-3-phenyl-iminopropene and then reacting the product with an equimolar amount of a 2,6-di-t-butyl-4-methylpyrylium salt as disclosed in Justus Liebigs Annalen der Chemie, Bd. 625, 74 (1959).

It is preferable that the first reaction is carried out in acetic anhydride and the second reaction is conducted in acetic anhydride in the presence of a base, e.g., anhydrous sodium acetate, etc. In the first reaction, the acetic anhydride is used in an amount of from 1 to 20 ml, and preferably from 2 to 10 ml, per gram of the 2,6-di-t-butyl-4-methylthiapyrylium. The reaction is carried out at a temperature of from 80° C. to a refluxing temperature, and preferably at around 100° C., for a period of time from 1 minute to 1 hour, and preferably from 10 to 30 minutes. Before performing the second reaction, the intermediate produced by the first reaction may be first isolated by diluting the reaction mixture with a poor organic solvent for the intermediate, such as diethyl ether, to precipitate the intermediate. The amount of the anhydrous sodium acetate used in the second reaction preferably ranges from 2 to 3 mols per mol of the 2,6-di-t-butyl-4-methylpyrylium. The reaction temperature and time for the second reaction are the same as for the first reaction.

The compounds represented by formula (II) can also be prepared in the same manner as described above.

The 2,6-di-t-butyl-4-methylthiapyrylium salts to be used as the starting compound can be synthesized by the processes described in U.S. Pat. No. 4,343,948 and Japanese Patent Application (OPI) Nos. 14560/81 and 14561/81 (the term "OPI" herein used means an unexamined published patent application). The 2,6-di-t-butyl-4-methylpyrylium salts and 2,6-diphenyl-4-methylpyrylium salts can be synthesized by the processes described in Liebigs Annalen der Chemie, Vol. 625, p. 74 (1959).

Specific but non-limiting examples of the compounds represented by formulae (I) and (II) which can be used in the invention are shown below. In the following formulae, -Bu represents $-C_4H_9$; and $-\phi$ represents $-C_6H_5$:

Compounds of Formula (I)

Compound (1)

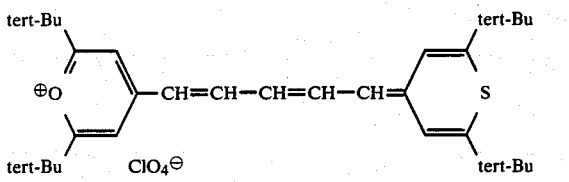

Compound (2)

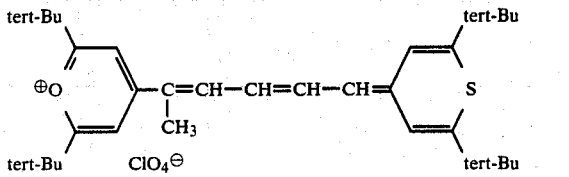

Compound (3)

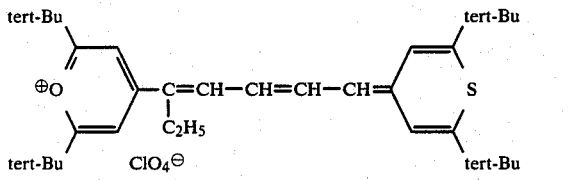

Compound (4)

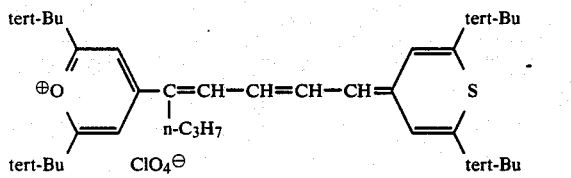

Compound (5)

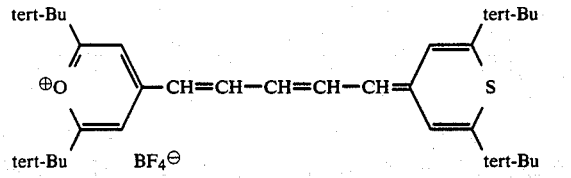

Compound (6)

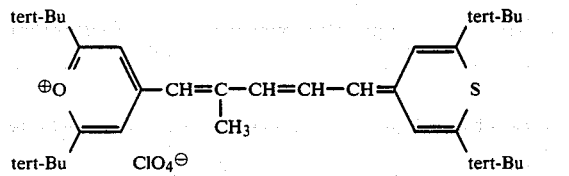

-continued

Compound (7)

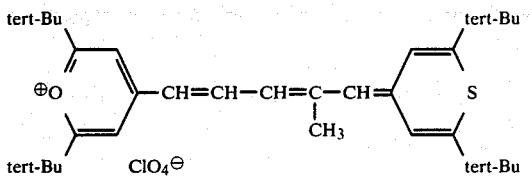

Compound (8)

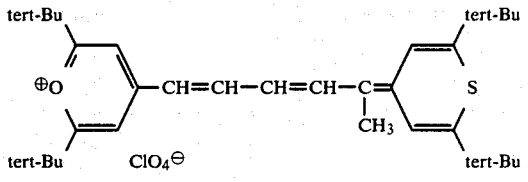

Compound (9)

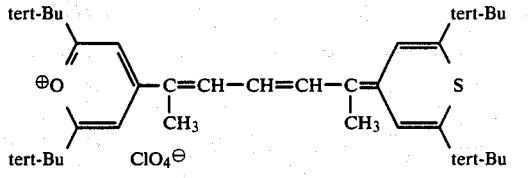

Compound (10)

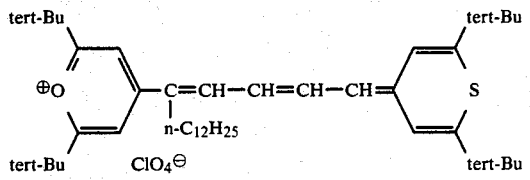

Compound (11)

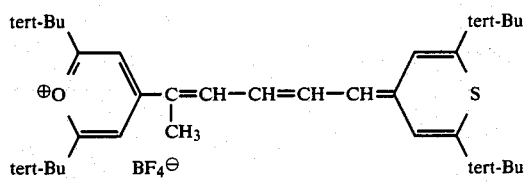

Compound (12)

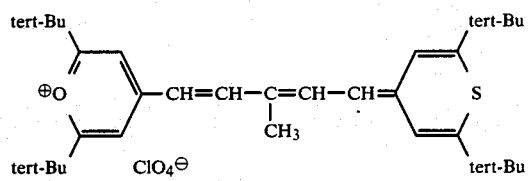

Compound (13)

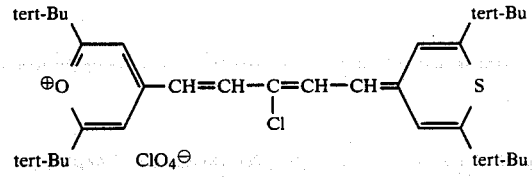

Compounds of Formula (II)

-continued
Compound (14)
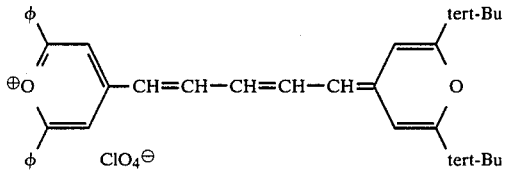
Compound (15)
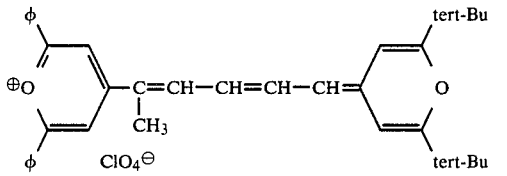
Compound (16)
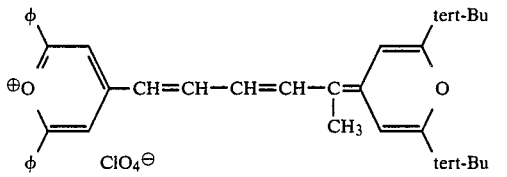
Compound (17)
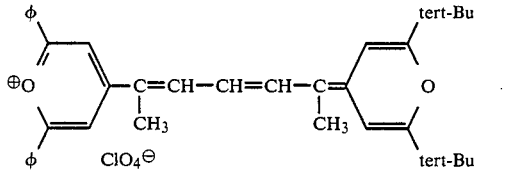
Compound (18)
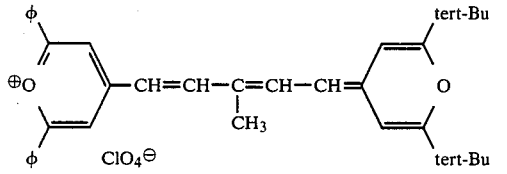
Compound (19)
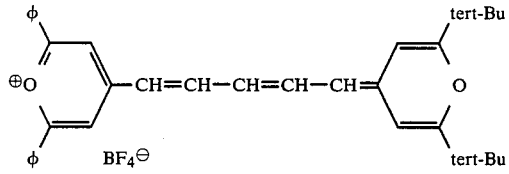
Compound (20)
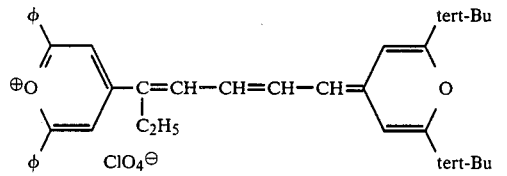
-continued
Compound (21)
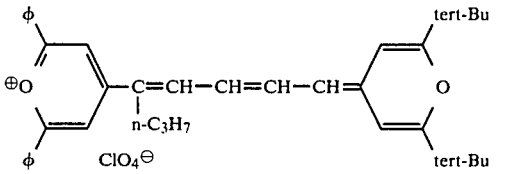
Compound (22)
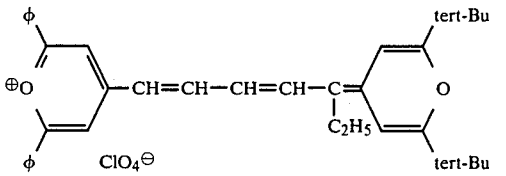
Compound (23)
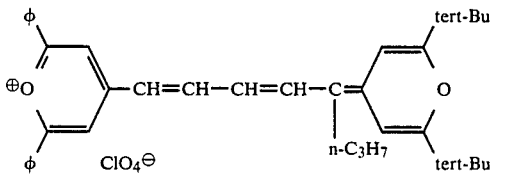
Compound (24)
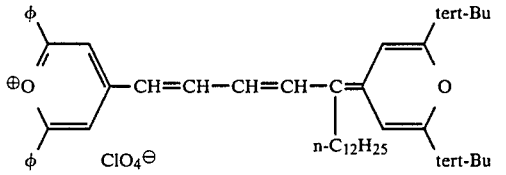
Compound (25)
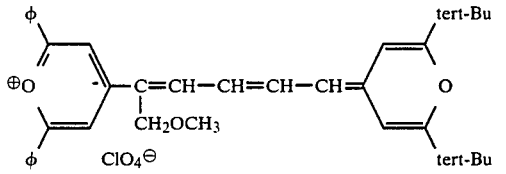
Compound (26)
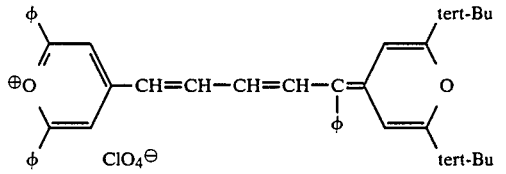
Compound (27)
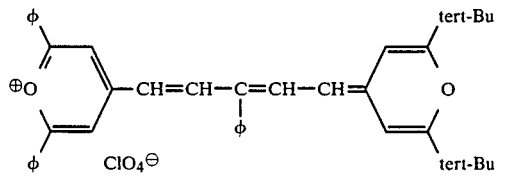

-continued

Compound (28)

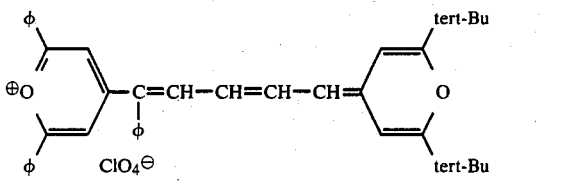

Compound (29)

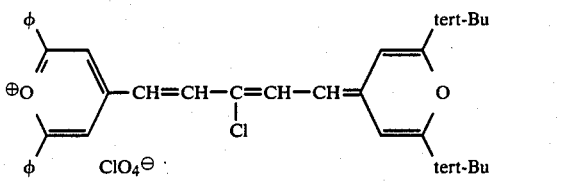

The amide compounds represented by the formulae (III) to (V) can all be synthesized according to the process described in *Bielstein's Handbuch der Organischen Chemie,* Vol. 12, p. 262, 1929.

In the formulae (III) to (V), the alkyl group as represented by $R_{11}$, $R_{12}$, or $R_{13}$ includes straight chain or branched alkyl groups having from 1 to 22 carbon atoms. Substituents for these alkyl groups include a halogen atom (e.g., a chlorine atom, a bromine atom, a fluorine atom, etc.), a cyano group, a nitro group, a phenyl group, a tolyl group, etc.

When $R_{11}$ represents an alkyl group, one of $R_{12}$ and $R_{13}$ is preferably a hydrogen atom or a straight or branched chain alkyl group having 1 to 5 carbon atoms. Also, when either one of $R_{12}$ and $R_{13}$ represents an alkyl group, the other is preferably a hydrogen atom or a straight or branched chain alkyl group having 1 to 5 carbon atoms.

The alkoxy group as represented by $R_{11}$ includes those having the above-described alkyl groups or substituted alkyl groups.

The monocyclic or bicyclic aryl groups as represented by $R_{11}$, $R_{12}$, and $R_{13}$ include a phenyl group, a naphthyl group, etc. The substituted monocyclic or bicyclic aryl groups for $R_{11}$, $R_{12}$, and $R_{13}$ include a phenyl group or a naphthyl group having from 1 to 3 substituents selected from a halogen atom (e.g., a chlorine atom, a bromine atom, a fluorine atom, etc.), a cyano group, a nitro group, a straight chain or branched alkyl group having from 1 to 5 carbon atoms, a straight chain or branched alkyl group having from 1 to 22 carbon atoms, which is substituted with a halogen atom (e.g., a chlorine atom, a bromine atom, a fluorine atom, etc.), a cyano group, a nitro group, a phenyl group, or a tolyl group, a straight chain or branched alkoxy group having from 1 to 5 carbon atoms, an alkoxycarbonyl group having a straight chain or branched alkyl moiety having from 1 to 5 carbon atoms and an acyl group having a straight chain or branched alkyl moiety having from 1 to 5 carbon atoms.

When either one of $R_{12}$ and $R_{13}$ is a substituted or unsubstituted aryl group as enumerated above, the other is preferably a hydrogen atom.

The substituted or unsubstituted monocyclic or bicyclic aryloxy groups as represented by $R_{11}$, $R_{12}$, and $R_{13}$ include those having the above-recited substituted or unsubstituted monocyclic or bicyclic aryl groups.

Monovalent groups derived from a monocyclic or bicyclic heterocyclic ring as represented by $R_{11}$, $R_{12}$, and $R_{13}$ include a pyrrolidinyl group, a piperidinyl group, a piperidino grup, a morpholinyl group, a morpholino group, a pyrrolyl group, an imidazolyl group, a pyridyl group, a pyridazinyl group, an indolinyl group, an isoindolinyl group, an indolyl group, an isoindolyl group, a benzimidazolyl group, a quinolyl group, an isoquinolyl group, etc. These aryloxy groups may have from 1 to 3 substituents selected from a halogen atom (e.g., a chlorine atom, a bromine atom, a fluorine atom, etc.), a cyano group, a nitro group, a phenyl group, a tolyl group, a benzyl group, a phenethyl group, and a straight chain or branched alkyl group having from 1 to 5 carbon atoms.

When either one of $R_{12}$ and $R_{13}$ represents such a monovalent group derived from a substituted or unsubstituted monocyclic or bicyclic hetero atom, the other is preferably a hydrogen atom.

When $R_{11}$ and $R_{12}$, or $R_{12}$ and $R_{13}$ in formula (III) are connected to each other; or when $R_{12}$ and $R_{13}$, $R_{12}$ and $R_{14}$, or $R_{13}$ and $R_{14}$ in formula (IV) are connected to each other; or when $R_{11}$ and $R_{14}$ in formula (V) are connected to each other, examples of the group formed by such a connection include a trimethylene gorup, a tetramethylene group, a pentamethylene group and a hydroxydiethylene group ($—CH_2—CH_2—O—CH_2—CH_2—$) and these divalent groups with 1 to 3 hydrogen atoms thereof being substituted with a halogen atom (e.g., a chlorine atom, a bromine atom, a fluorine atom), a cyano group, a nitro group, a phenyl group, a tolyl group, a benzyl group, a phenethyl group, or a straight chain or branched alkyl group having from 1 to 5 carbon atoms.

When $R_{11}$, $R_{12}$, and $R_{13}$ each represents an alkyl, alkoxy, aryl, aryloxy, or hetero ring-derived monovalent group having from 1 to 3 substituents, these substituents may be arbitrarily selected in any combination.

The polymethylene group as represented by $R_{14}$ includes those having from 2 to 22 carbon atoms. The branched alkylene group as represented by $R_{14}$ includes those having from 3 to 22 carbon atoms, in which two carbon atoms at optional positions each carries one free monovalence. The arylene group as represented by $R_{14}$ includes an o-, m-, or p-phenylene group and a naphthylene group carrying one free monovalence on each of two carbon atoms at optional positions thereof.

Specific but non-limiting examples of the amide compounds of the formulae (III), (IV), and (V) which can be used in the present invention are shown below:

Amide Compound (A)

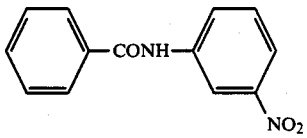

Amide Compound (B)

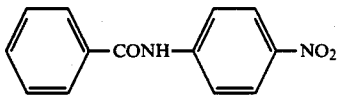

Amide Compound (C)

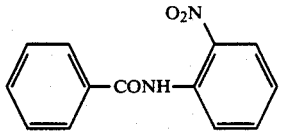

-continued

Amide Compound (D)

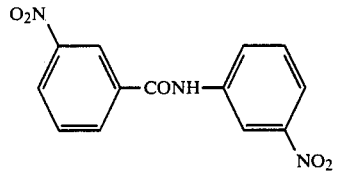

Amide Compound (E)

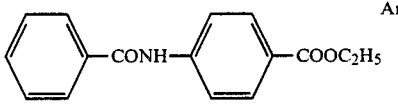

Amide Compound (F)

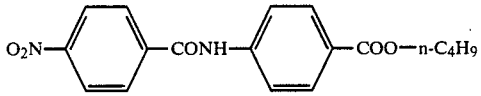

Amide Compound (G)

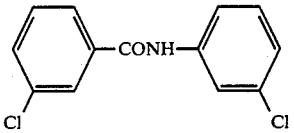

Amide Compound (H)

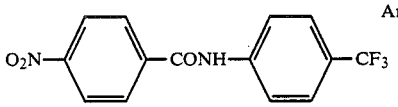

Amide Compound (I)

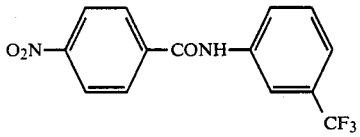

Amide Compound (J)

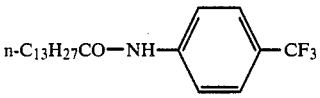

Amide Compound (K)

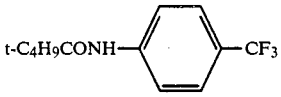

Amide Compound (L)

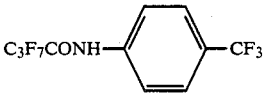

Amide Compound (M)

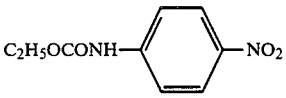

Amide Compound (N)

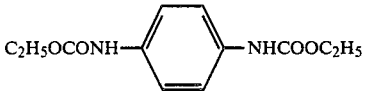

Amide Compound (O)

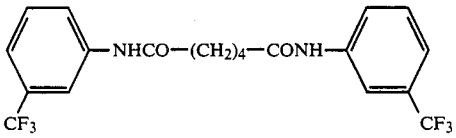

-continued

Amide Compound (P)

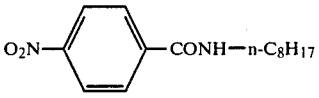

The improved electrophotographic photosensitive materials according to the present invention essentially comprise a support and a photosensitive layer.

The support which can be used in this invention should be rendered electrically conductive. Treatments for rendering the support electrically conductive include vapor deposition of a metal, e.g., aluminum, gold, palladium, indium, etc., or a metal oxide, e.g., $In_2O_3$, $SnO_2$, etc., coating of a dispersion of a metal powder or a metal oxide, e.g., $SnO_2$, etc., in a polymer binder, coating of a solution of an organic quaternary salt compound, e.g., in a polymer binder, coating of an acetonitrile solution of copper iodide, and the like.

The organic photoconductive substance which can be used in the present invention includes a number of high-molecular weight compounds and low-molecular weight compounds conventionally known.

Examples of the high-molecular weight photoconductive substances are as follows:

(1) Polyvinylcarbazole and derivatives thereof as described in U.S. Pat. No. 3,037,861 and Japanese Patent Publication Nos. 10966/59, 19751/67 and 25230/67.

(2) Vinyl polymers, such as polyvinylpyrene, polyvinylanthracene, poly-2-vinyl-4-(4'-dimethylaminophenyl)-5-phenyloxazole, poly-3-vinyl-N-ethylcarbazole, etc., as described in Japanese Patent Publication Nos. 18674/68 and 19192/68.

(3) Polymers such as polyacenaphthylene, polyindene, an acenaphthylene-styrene copolymer, etc., described in Japanese Patent Publication No. 19193/68, (4) Condensed resins, such as a pyrene-formaldehyde resin, a bromopyrene-formaldehyde resin, an ethylcarbazole-formaldehyde resin, etc., as described in Japanese Patent Publication No. 13940/81, and (5) Various triphenylmethane polymers described in Japanese Patent Application (OPI) Nos. 90883/81 and 161550/81.

Examples of usable low-molecular weight photoconductive substances are shown below:

(6) Triazole derivatives as described in U.S. Pat. No. 3,112,197, (7) Oxadiazole derivatives as described in U.S. Pat. No. 3,189,447, (8) Imidazole derivatives as described in Japanese Patent Publication No. 16096/62, (9) Polyarylalkane derivatives as described in U.S. Pat. Nos. 3,615,402, 3,820,989 and 3,542,544, Japanese Patent Publication Nos. 555/70 and 10983/76 and Japanese Patent Application (OPI) Nos. 93224/76, 17105/80, 4148/81, 108667/80, 156953/80 and 36656/81,

(10) Pyrazoline derivatives and pyrazolone derivatives as described in U.S. Pat. Nos. 3,180,729 and 4,278,746 and Japanese Patent Application (OPI) Nos. 88064/80, 88065/80, 105537/74, 51086/80, 80051/81, 88141/81, 45545/82, 112637/79 and 74546/80,

(11) Phenylenediamine derivatives as described in U.S. Pat. No. 3,615,404, Japanese Patent Publication No. 10105/76, Japanese Patent Application (OPI) Nos.

83435/79, 110836/79 and 119925/79 and Japanese Patent Publication Nos. 3712/71 and 28336/72,

(12) Arylamine derivatives as described in U.S. Pat. No. 3,567,450, Japanese Patent Publication No. 35702/74, West German Patent (DAS) No. 1,110,518, U.S. Pat. Nos. 3,180,703, 3,240,597, 3,658,520, 4,232,103, 4,175,961 and 4,012,376, Japanese Patent Application (OPI) No. 119132/81, Japanese Patent Publication No. 27577/64 and Japanese Patent Application (OPI) No. 22437/81,

(13) Amino-substituted benzalacetophenone derivatives as described in U.S. Pat. No. 3,526,501,

(14) N,N-Bicarbazyl derivatives as described in U.S. Pat. No. 3,542,546,

(15) Oxazole derivatives as described in U.S. Pat. No. 3,257,203,

(16) Styrylanthracene derivatives as described in Japanese Patent Application (OPI) No. 46234/81,

(17) Fluorenone derivatives as described in Japanese Patent Application (OPI) No. 110837/79,

(18) Hydrazone derivatives as described in U.S. Pat. Nos. 3,717,462 and 4,150,987 and Japanese Patent Application (OPI) Nos. 52063/80, 52064/80, 46760/80, 85495/80, 11350/82, 148749/82 and 64244/82, and

(19) Benzidine derivatives as described in Japanese Patent Publication No. 11546/64 and U.S. Pat. Nos. 4,265,990 and 4,047,949.

In the case of using low-molecular weight compounds as an organic photoconductive substance, an appropriate high-molecular weight compound having film-forming properties can be used as a binder. Such a high-molecular compound includes polyamide, polyurethane, polyesters, epoxy resins, polyketones, styrene polymers or copolymers, poly-N-vinylcarbazole, polycarbonates, polysulfones, vinyl chloride resins, vinylidene chloride resins, vinyl acetate resins, acrylic resins, and so on.

The high-molecular weight organic photoconductive substances have film-forming properties in themselves, but the above-described high-molecular weight binders may also be used, if desired.

Chemical sensitizers can be employed in the photosensitive materials of this invention. Examples of the chemical sensitizers to be used include electron-attractive compounds, such as trinitrofluorenone, chloranil, tetracyanoethylene, etc., and the compounds disclosed in Japanese Patent Application (OPI) Nos. 65439/83 and 102239/83, etc.

The electrophotographic photosensitive materials in accordance with the present invention may contain, if desired, known additives, such as binding agents, plasticizers, dyes, pigments, and the like within such a range that does not impair characteristics of the electrophotographic photosensitive materials of the invention.

Examples of the binding agent to be added are cyanoethyl cellulose, nitrile rubber, bisphenol A polycarbonate, linear polyester, styrene-butadiene copolymers, vinylidene chloride-acrylonitrile copolymers, and the like.

Examples of the plasticizers to be added include epoxy resins, triphenylmethane compounds, coumarone resins, low molecular weight xylene resins, and the like.

The electrophotographic photosensitive materials of the present invention may further contain other plasticizers as described in Japanese Patent Publication No. 46263/74, silane coupling agents, hardening catalysts and/or crosslinking agents as described in Japanese Patent Publication No. 19423/82, fluorine-containing surface active agents as described in Japanese Patent Publication No. 88025/76, Lewis acids as described in Japanese Patent Publication No. 19424/82, and electron donating substances as described in Japanese Patent Publication No. 19782/82.

In the preparation of the electrophotographic photosensitive materials of the invention, solvents capable of dissolving or dispersing all of the high-molecular weight organic photoconductive substance, sensitizing dye, and other additives, if any, can be selected appropriately from benzene, toluene, xylene, chlorobenzene, dichloromethane, dichloroethane, trichloroethane, cyclohexanone, tetrahydrofuran, dioxane, etc., and mixtures thereof.

The photosensitive materials of the present invention can be obtained by dissolving or dispersing all the components, i.e., the photoconductive substance, the pyrylium compound and, optionally, amide compound of the invention and additives, if used, in a solvent in desired proportions and coating the solution or dispersion on a conductive support, followed by drying, or coating a molten mixture of the above-described components on a conductive support. Alternatively, a photoconductive thin film can be prepared from the above-described solution or by melt-extrusion of the above-described mixture to thereby form a self-supporting film. In the coating, the coating composition may contain known surface active agents for coating.

The pyrylium compounds according to the present invention are used in an amount necessary to sensitize the organic photoconductive material. Such an amount, though somewhat varying depending on the type of the organic photoconductive material, generally ranges from 0.01 wt% to 100 wt%, and preferably from 0.1 wt% to 30 wt%, based on the amount of organic photoconductive substance.

The proportion of the amide compounds of the invention in the photoconductive composition is decided by a relation to the amount of the organic photoconductive material that contributes to photoconductive insulating properties, and usually ranges from 1 wt% to 100 wt%, and preferably 3 wt% to 30 wt%, based on the organic photoconductive substance. Proportions of the amide compound exceeding the above upper limit give adverse influences on electrophotographic characteristics, such as reduction in sensitivity and increase in residual potential.

The amount of the binder to be added varies depending on the kind of the organic photoconductive material. It preferably ranges from 30 to 180% by weight in the case of low-molecular weight organic photoconductive materials and from 1 to 50% by weight in the case of high-molecular weight organic photoconductive material, both based on the amount of the organic photoconductive substance.

The electrophotographic photosensitive materials of the invention may have a surface protective layer, such as a layer comprising a binder resin having dispersed therein fine particles. Specific but non-limiting examples of the binder resin to be employed are polyester carbonates, polysulfones, polyethers, polyesters, polycarbonates, polyamides, polyimides, polyurethanes, acrylic ester polymers or copolymers, methacrylic ester polymers or copolymers, styrene resins, polyvinyl acetal, polyvinyl carbazole, vinyl chloride resins, vinylidene chloride resins, chlorinated polyolefins, vinyl acetate resins, alkyd resins, xylene resins, ketone resins, cellulose derivatives, and the like. These binder resins can be used either individually or in combinations of two or more thereof.

Various kinds of fine particles can be used in the protective layer. Specific examples thereof are inorganic insulating fine particles, such as silica, calcium carbonate, mica, clay, boron nitride, etc.; metal oxides, such as titanium oxide, aluminum oxide, magnesium oxide, zinc oxide, tin dioxide, bismuth oxide, etc.; long-chain organic acid metal salts, such as zinc stearate, calcium stearate, zinc laurate, etc.; organic fine particles, such as polypropylene, polyethylene, polyamide, polyvinylidene fluoride, polytetrafluoroethylene, etc.; and the like. Of these fine particles, the preferred are silica, aluminum oxide, and titanium oxide because of ease in dispersing.

If desired, an intermediate layer may be provided between the support and the photosensitive layer or between the photosensitive layer and the protective layer for various purposes, such as improvement in adhesion, and the like.

Further, the electrophotographic photosensitive material of the invention may further have a layer on its back side in order to improve various characteristics, such as slipperiness, electrification properties, antiblocking properties, antihalation properties, and the like.

The present invention will now be illustrated in greater detail with reference to examples of synthesis of the compounds of the invention and working examples of the invention, but it should be understood that these examples are not intended to limit the present invention.

SYNTHESIS EXAMPLE 1

Synthesis of 2,6-Di-t-Butyl-4-Ethylpyrylium Perchlorate

To a mixture consisting of 104.2 g (0.40 mol) of tin tetrachloride and 96.6 g (0.08 mol) of pivaloyl chloride was added dropwise 30.8 g (0.44 mol) of 2-methyl-2-propene under ice-cooling and stirring. After the dropwise addition, stirring was continued for an additional one hour. The reaction mixture was poured into 500 g of ice-water containing 60 wt% perchloric acid while vigorously stirring. After stirring was continued for an additional one hour, the precipitated solid was collected and recrystallized from 120 ml of ethyl acetate to obtain 29.58 g (yield: 23.1%) of 2,6-di-t-butyl-4-ethylpyrylium perchlorate as a white needle-like crystal having a melting point of 160° to 164° C.

| Elementary Analysis for $C_{15}H_{25}O_5Cl_1$: | | | |
|---|---|---|---|
| | C | H | Cl |
| Calcd. (%): | 56.16 | 7.85 | 11.05 |
| Found (%): | 55.90 | 7.86 | 11.02 |

SYNTHESIS EXAMPLE 2

Synthesis of Compound (2)

2,6-Di-t-butyl-4-methylthiapyrylium perchlorate (2.9 g; 0.01 mol) and 2.2 g (0.01 mol) of 1-anilino-3-phenyliminopropene were thoroughly mixed, and 5 ml of acetic anhydride was added thereto. The mixture was heated to 100° C., followed by stirring for 10 minutes. To the mixture were then added 3.2 g (0.01 mol) of the pyrylium salt as synthesized in Synthesis Example 1 and 1.97 g (0.024 mol) of anhydrous sodium acetate, and stirring was further continued for 30 minutes. After cooling to room temperature, 10 ml of ethyl acetate was added to the reaction mixture, followed by stirring under ice-cooling. The crystals thus precipitated were collected by filtration, washed with water, and dried. Recrystallization from a mixed solvent of ethyl acetate and ethanol (3/1 by volume) gave 2.01 g (yield: 34.7%) of Compound (2) as a greenish golden crystal having a melting point of 235° to 236° C. (with decomposition).

| Elementary Analysis for $C_{32}H_{47}Cl_1O_5S_1$: | | | | |
|---|---|---|---|---|
| | C | H | Cl | S |
| Calcd. (%): | 66.35 | 8.19 | 6.12 | 5.53 |
| Found (%): | 66.12 | 8.25 | 6.18 | 5.48 |

SYNTHESIS EXAMPLE 3

Synthesis of Compound (4)

To an anhydrous tetrahydrofuran solution cooled to −20° C. and containing 416 mg (2 mmol) of 2,6-di-t-butyl-γ-pyrone was added dropwise 1.29 ml of a 1.87M hexane solution containing n-butyl lithium (2.4 mmol) to effect reaction. One hour later, the reaction mixture was poured into 50 ml of a 6 wt% aqueous solution of perchloric acid, and the thus precipitated oily substance was extracted with 40 ml of methylene chloride. The extract was dried over sodium sulfate, and the solvent was removed by distillation to obtain 544 mg (yield: 78.1%) of 2,6-di-t-butyl-4-n-butyl-pyrylium perchlorate as a white solid.

In the same manner as described in Synthesis Example 2, except using the above obtained pyrylium salt, Compound (4) was obtained as a greenish golden crystal having a melting point of 218° to 221° C. (with decomposition).

SYNTHESIS EXAMPLE 4

Synthesis of Compound (14)

2,6-Di-t-butyl-4-methylpyrylium perchlorate (3.07 g; 0.01 mol) and 2.22 g (0.01 mol) of 1-anilino-3-phenyliminopropene were thoroughly mixed, and 5 ml of acetic anhydride was added thereto. The mixture was heated to 100° C., followed by stirring for 10 minutes. To the mixture were then added 3.47 g (0.01 mol) of 2,6-diphenyl-4-methylpyrylium perchlorate and 1.97 g (0.024 mmol) of anhydrous sodium acetate, followed by stirring for 30 minutes. After cooling to room temperature, 50 ml of diethyl ether was added to the reaction mixture, and stirring was continued under ice-cooling. The precipitated crystal was collected by filtration, washed with water and dried. Recrystallization from methanol gave 2.49 g of (yield: 43%) of Compound (14) as reddish purple crystals having a melting point of 182° to 186° C. (with decomposition).

| Elementary Analysis for $C_{35}H_{37}Cl_1O_6$: | | | |
|---|---|---|---|
| | C | H | Cl |
| Calcd. (%): | 71.36 | 6.33 | 6.02 |
| Found (%): | 71.13 | 6.32 | 6.12 |

SYNTHESIS EXAMPLE 5

Synthesis of Compound (16)

To a mixture of 104.2 g (0.40 mol) of tin tetrachloride and 96.6 g (0.80 mol) of pivaloyl chloride was added dropwise 30.8 g (0.44 mol) of 2-methyl-2-propene under ice-cooling while stirring. After the dropwise addition, stirring was continued for an additional one hour. The reaction mixture was poured into 500 g of ice-water containing 60 g of a 60 wt% aqueous solution of perchloric acid while vigorously stirring, and the stirring was further continued for 1 hour. The precipitated solid was collected and recrystallized from 120 ml of ethyl acetate to obtain 29.58 g (yield: 23.1%) of 2,6-di-t-butyl-4-ethylpyrylium perchlorate as a white needle-like crystal having a melting point of 160° to 164° C.

| Elementary Analysis for $C_{15}H_{25}O_5Cl_1$: | | | |
|---|---|---|---|
| | C | H | Cl |
| Calcd. (%): | 56.16 | 7.85 | 11.05 |
| Found (%): | 55.90 | 7.86 | 11.02 |

In the same manner as described in Synthesis Example 4, except using the above prepared pyrylium salt and 2,6-diphenyl-4-methylpyrylium perchlorate, Compound (16) was obtained as a greenish golden crystal having a melting point of 238° to 239° C.

| Elementary Analysis for $C_{36}H_{39}O_6Cl_1$: | | | |
|---|---|---|---|
| | C | H | Cl |
| Calcd. (%): | 71.69 | 6.52 | 5.88 |
| Found (%): | 71.43 | 6.53 | 5.90 |

SYNTHESIS EXAMPLE ≠

Synthesis of Compound (21)

A 1.7M hexane solution (3.5 ml) containing 6 mmol of n-butyl lithium was added dropwise to 10 ml of an anhydrous tetrahydrofuran solution containing 1.24 g (5 mmol) of 2,6-diphenyl-γ-pyrone which was cooled to −20° C. One hour later, the reaction mixture was poured into 50 ml of a 6 wt% aqueous solution of perchloric acid. The precipitated solid was collected by filtration, dissolved in a small amount of methylene chloride and reprecipitated in diethyl ether. The precipitated yellow solid was separated by filtration and dried to obtain 0.88 g (yield: 45%) of 2,6-diphenyl-3-n-propylpyrylium perchlorate.

In the same manner as described in Synthesis Example 4, except using the above prepared crude crystals of the pyrylium salt and 2,6-di-t-butyl-4-methylpyrylium perchlorate, Compound (21) was obtained as a reddish golden crystal having a melting point of 233° to 235° C.

| Elementary Analysis for $C_{38}H_{43}O_6Cl_1$: | | | |
|---|---|---|---|
| | C | H | Cl |
| Calcd. (%): | 72.31 | 6.87 | 5.62 |
| Found (%): | 72.21 | 6.85 | 5.59 |

EXAMPLE 1

A photosensitive coating composition having the following formulation was coated with a wire bar on a 100 μm thick polyethylene terephthalate film on which indium oxide had been vacuum deposited, followed by drying to obtain an electrophotographic film having an 8.7 μm thick photoconductive layer.

| Photosensitive Coating Composition: | |
|---|---|
| N,N'—Diphenyl-N,N'—bis(3-methylphenyl)-[1,1'-biphenyl]-4,4'-diamine | 0.3 g |
| Compound (2) | 2.85 mg ($5 \times 10^{-6}$ mol) |
| Polycarbonate (Panlight K1300, produced by Teijin, Limited) | 0.5 g |
| Linear polyester resin (Vylon 200, produced by Toyo Spinning Co., Ltd.) | 0.01 g |
| Amide Compound (F) | 64 mg |
| Dichloromethane | 3 ml |
| Dichloroethane | 1 ml |

The absorption spectrum of the resulting film is shown in FIG. 1. As is apparent from FIG. 1, this film exhibits its absorption maximum at 788 nm, that is, within the oscillation region of a semi-conductor laser, with its absorption in the shorter wavelength region (400 to 500 nm) offering no substantial problem.

The electrophotographic characteristics of the resulting electrophotographic film were determined by electrostatically charging by corona discharge at a voltage of +7.5 KV, and then exposing to monochromatic light of 788 nm by means of a copying paper tester (SP-428, manufactured by Kawaguchi Denki K.K.).

Retention of electric charge was determined by measuring a potential in dark after 60 seconds from the corona charging to obtain a percentage of retention of the initial potential. Sensitivity was evaluated by measuring exposures which caused light decay of the potential before the exposure to ½ ($E_{50}$) and to 1/10 ($E_{90}$).

As a result, the film showed a retention of electric charge as satisfactory at 90% and markedly high sensitivity as having $E_{50}$ of 95 erg/cm$^2$ and $E_{90}$ of 591 erg/cm$^2$ at an electric field strength of $0.78 \times 10^6$ V/cm.

When a tungsten lamp (4 lux) was used as a light source, the results were satisfactory as being 90% in retention of electric charge and 26 lux·sec in $E_{50}$ and 172 lux·sec in $E_{90}$ at a field strength of $0.78 \times 10^6$ V/cm.

Even when the above electrophotographic film was left to stand for 10 weeks under conditions of 50° C. and 80% RH, no substantial change was observed in the absorption maximum and electrophotographic characteristics.

EXAMPLE 2

An electrophotographic film was obtained in the same manner as described in Example 1, except using Compound (1), (3), or (4) according to the present invention in place of Compound (2) as used in Example 1. Each of the resulting films was evacuated for absorption maximum and electrophotographic characteristics in the same manner as in Example 1. The results obtained are shown in Table 1 below.

TABLE 1

| Sample No. | Pyrylium Compound | Absorption Maximum (nm) | Retention of Electric Charge (%) | $E_{50}$ (erg/cm$^2$) | $E_{90}$ (erg/cm$^2$) | Field Strength (V/cm) |
|---|---|---|---|---|---|---|
| 1 | Compound (1) | 774 | 90 | 48 | 309 | $1.27 \times 10^6$ |
| 2 | Compound (3) | 787 | 92 | 73 | 493 | $0.87 \times 10^6$ |

TABLE 1-continued

| Sample No. | Pyrylium Compound | Absorption Maximum (nm) | Retention of Electric Charge (%) | $E_{50}$ (erg/cm$^2$) | $E_{90}$ (erg/cm$^2$) | Field Strength (V/cm) |
|---|---|---|---|---|---|---|
| 3 | Compound (4) | 787 | 92 | 71 | 500 | $0.83 \times 10^6$ |

As is apparent from Table 1, all of these films according to the present invention exhibit their absorption maxima within an oscillation region of a semi-conductor laser and have satisfactory sensitivity.

When these films were left to stand for 10 weeks under conditions of 50° C. and 80% RH, no substantial change in these characteristics was noted.

EXAMPLE 3

A photosensitive coating composition having the following formulation was coated with a wire bar on a 100 μm thick polyethylene terephthalate film on which indium oxide had been vacuum deposited, followed by drying to obtain an electrophotographic film having an 8.4 μm thick photoconductive layer.

| Photosensitive Coating Composition: | |
|---|---|
| N,N'—Diphenyl-N,N'—bis(3-methylphenyl)-[1,1'-biphenyl]-4,4'-diamine | 0.3 g |
| Compound (15) | 3.01 mg ($5 \times 10^{-6}$ mol) |
| Polycarbonate (Panlight K1300, produced by Teijin, Limited) | 0.5 g |
| Linear polyester resin (Vylon 200, produced by Toyo Spinning Co., Ltd.) | 0.01 g |
| Amide Compound (F) | 64 mg |
| Dichloromethane | 4 ml |

Figure 2:
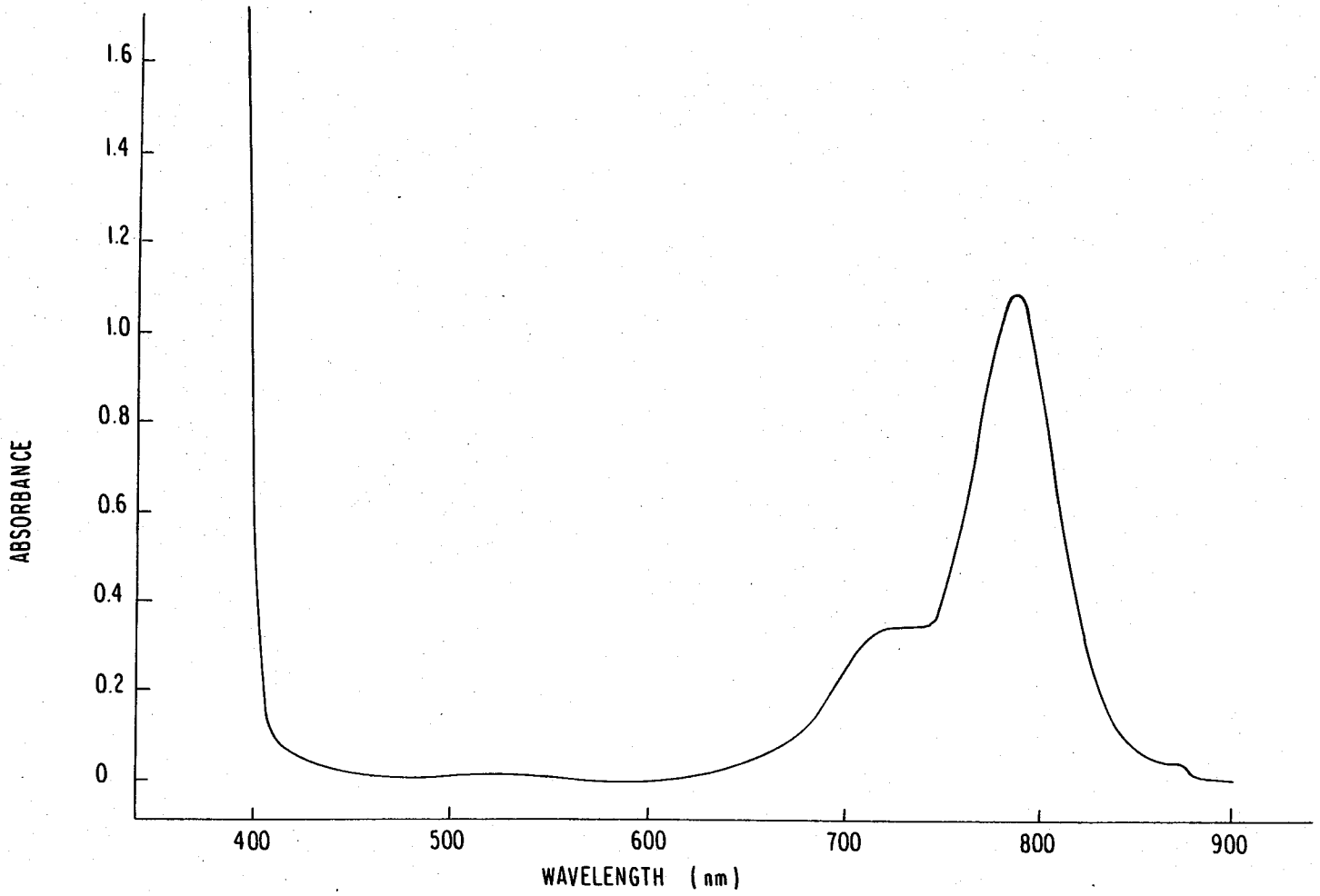
FIG. 2 shows an absorption spectrum of the electrophotographic film of Example 3 in the visible to near infrared regions.

The absorption spectrum of the resulting film is shown in FIG. 2. As is apparent from FIG. 2, this film exhibits its absorption maximum at 785 nm, which is within the oscillation region of a semi-conductor laser.

The electrophotographic characteristics of the resulting film were determined in the same manner as described in Example 1, except for using monochromatic light having a wavelength of 785 nm for exposure.

As a result, the film showed a retention of electric charge as satisfactory at 90% and markedly high sensitivity, having $E_{50}$ of 99 erg/cm$^2$ and $E_{90}$ of 641 erg/cm$^2$ at an electric field strength of $0.81 \times 10^6$ V/cm.

When a tungstem lamp (4 lux) was used as a light source, the results were satisfactory as being 90% in retention of electric charge and $E_{50}$ of 26 lux·sec and $E_{90}$ of 187 lux·sec at a field strength of $0.84 \times 10^6$ V/cm.

Even when the above electrophotographic film was left to stand for 10 weeks under conditions of 50° C. and 80% RH, no substantial change was observed in absorption maximum and electrophotographic characteristics.

EXAMPLE 4

An electrophotographic film was obtained in the same manner as described in Example 3, except using Compound (14), (16), or (21) in place of Compound (15) that was used in Example 3. Each of the resulting films was evaluated for absorption maximum and electrophotographic characteristics in the same manner as in Example 1. The results obtained are shown in Table 2 below.

TABLE 2

| Sample No. | Pyrylium Compound | Absorption Maximum (nm) | Retention of Electric Charge (%) | $E_{50}$ (erg/cm$^2$) | $E_{90}$ (erg/cm$^2$) | Field Strength (V/cm) |
|---|---|---|---|---|---|---|
| 4 | Compound (14) | 769 | 86 | 85 | 658 | $0.70 \times 10^6$ |
| 5 | Compound (16) | 781 | 90 | 107 | 718 | $0.76 \times 10^6$ |
| 6 | Compound (21) | 782 | 90 | 85 | 660 | $0.72 \times 10^6$ |

As is apparent from Table 2, all of these films exhibit their absorption maxima within the oscillation region of a semi-conductor laser and satisfactory electrophotographic sensitivity. When these films were allowed to stand for 10 weeks under conditions of 50° C. and 80% RH, there was noted no substantial change in the above-described various characteristics.

EXAMPLE 5

Electrophotographic films were prepared in the same manner as in Example 1, except using the pyrylium compounds and amide compounds shown in Table 3. The absorption maxima and electrophotographic characteristics of the resulting films were determined in the same manner as in Example 1. The results obtained are shown in Table 3.

It can be seen from Table 3 that these electrophotographic films exhibit good electrophotographic sensitivity and their absorption maxima are within the oscillation region of a semi-conductor laser.

Even when these films were allowed to stand for 10 weeks under conditions of 50° C. and 80% RH, they underwent no substantial change in absorption maximum or electrophotographic characteristics.

TABLE 3

| Sample No. | Pyrylium Compound | Amide Compound | Absorption Maximum (nm) | Retention of Electric Charge (%) | $E_{50}$ (erg/cm$^2$) | $E_{90}$ (erg/cm$^2$) | Field Strength (V/cm) |
|---|---|---|---|---|---|---|---|
| 7 | Compound (2) | Compound (A) | 787 | 89 | 90.5 | 555 | $0.75 \times 10^6$ |
| 8 | " | Compound (H) | 779 | 92 | 80 | 576 | $0.84 \times 10^6$ |
| 9 | " | Compound (I) | 780 | 91 | 97 | 760 | $0.75 \times 10^6$ |
| 10 | " | Compound (J) | 777 | 90 | 86 | 588 | $0.80 \times 10^6$ |
| 11 | " | Compound (K) | 777 | 90 | 83 | 546 | $0.80 \times 10^6$ |
| 12 | " | Compound (L) | 775 | 83 | 108 | 453 | $0.87 \times 10^6$ |
| 13 | Compound (16) | Compound (I) | 780 | 90 | 89 | 698 | $0.80 \times 10^6$ |

EXAMPLE 6

An electrophotographic film was prepared in the same manner as described in Example 1, and Sample Nos. 5 and 6 of Example 4, except for using no amide compound. The absorption maximum and electrophotographic properties of the resulting film were determined in the same manner as in Example 1. The results obtained are shown in Table 4 below.

TABLE 4

| Sample No. | Pyrylium Compound | Absorption Maximum (nm) | Retention of Electric Charge (%) | $E_{50}$ (erg/cm$^2$) | Field Strength (V/cm) |
|---|---|---|---|---|---|
| 14 | Compound (2) | 781 | 93 | 637 | $0.88 \times 10^6$ |
| 15 | Compound (16) | 776 | 94.9 | 128 | $0.84 \times 10^6$ |
| 16 | Compound (21) | 776 | 89.8 | 595 | $0.78 \times 10^6$ |

As can be seen from Table 4, each of the films of Sample Nos. 14, 15 and 16 has its absorption maximum in a satisfactory region, but is inferior to the film of Example 1 in sensitivity.

When the above Sample Nos. 14, 15 and 16 were left to stand for 10 weeks under conditions of 50° C. and 80% RH, no substantial change in absorption maximum and electrophotographic characteristics were observed, as in the case of Example 1.

While the invention has been described in detail and with reference to specific embodiments thereof, it will be apparent to one skilled in the art that various changes and modifications can be made therein without departing from the spirit and scope thereof.

What is claimed is:

1. An electrophotographic photosensitive material containing (1) an organic photoconductive substance, and (2) at least one of pyrylium compounds represented by the formulae (I) and (II):

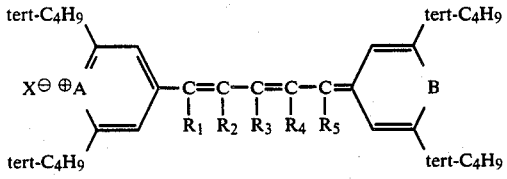

(I)

wherein $R_1$, $R_2$, $R_4$, and $R_5$ each represents a hydrogen atom or a substituted or unsubstituted alkyl group; $R_3$ represents a hydrogen atom, a halogen atom, or a substituted or unsubstituted alkyl group; either one of A and B represents an oxygen atom, and the other representing a sulfur atom; and X represents an anion;

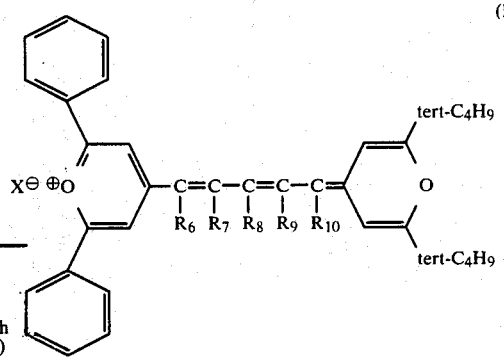

(II)

wherein $R_6$, $R_7$, $R_9$, and $R_{10}$ each represents a hydrogen atom, a substituted or unsubstituted alkyl group, or a substituted or unsubstituted aryl group; $R_8$ represents a hydrogen atom, a halogen atom, a substituted or unsubstituted alkyl group, or a substituted or unsubstituted aryl group; and X represents an anion.

2. An electrophotographic photosensitive material as in claim 1, wherein said material further contains at least one of amide compounds represented by formulae (II), (IV), and (V):

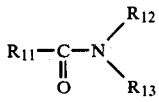
(III)

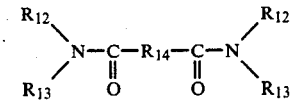
(IV)

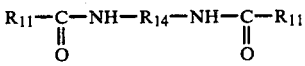
(V)

wherein $R_{11}$ represents a substituted or unsubstituted alkyl group, a substituted or unsubstituted alkoxy group, a substituted or unsubstituted monocyclic or bicyclic aryl group, a substituted or unsubstituted monocyclic or bicyclic aryloxy group, or a monovalent group derived from a substituted or unsubstituted heterocyclic ring; the two $R_{11}$ groups in formula (V) may be the same or different; $R_{12}$ and $R_{13}$ each represents a hydrogen atom, a substituted or unsubstituted alkyl group, a substituted or unsubstituted monocyclic or bicyclic aryl group, or a monovalent group derived from a substituted or unsubstituted hetero ring; $R_{14}$ represents a methylene group, a polymethylene group, a branched alkylene group, or an arylene group; and $R_{11}$ and $R_{12}$, $R_{12}$ and $R_{13}$, $R_{12}$ and $R_{14}$, $R_{13}$ and $R_{14}$, or $R_{11}$ and $R_{14}$ may be connected to each other.

3. An electrophotographic photosensitive material as in claim 1, wherein each of the alkyl groups represented by $R_1$, $R_2$, $R_3$, $R_4$, $R_5$, $R_6$, $R_7$, $R_8$, $R_9$, and $R_{10}$ contains from 1 to 18 carbon atoms, and each of the aryl groups as represented by $R_6$, $R_7$, $R_8$, $R_9$, and $R_{10}$ contains from 6 to 24 carbon atoms.

4. An electrophotographic photosensitive material as in claim 2, wherein each of the alkyl or alkoxy groups as represented by $R_{11}$, $R_{12}$, and $R_{13}$ contains from 1 to 22 carbon atoms; each of the aryl groups as represented by $R_{11}$, $R_{12}$, and $R_{13}$ is a substituted or unsubstituted phenyl or naphthyl group; each of the aryloxy groups as represented by $R_{11}$, $R_{12}$, and $R_{13}$ is a substituted or unsubstituted phenoxy or naphthoxy group; the polymethylene group as represented by $R_{14}$ contains from 2 to 22 carbon atoms; the branched alkylene group as represented by $R_{14}$ contains from 3 to 22 carbon atoms; and the arylene group as represented by $R_{14}$ is an o-, m-, or p-phenylene or naphthylene group.

5. An electrophotographic photosensitive material as in claim 2, wherein one of $R_{12}$ and $R_{13}$ is a hydrogen atom and the other is an aryl group, an aryloxy group, or a monovalent group derived from a heterocyclic ring.

6. An electrophotographic photosensitive material as in claim 1, wherein said pyrylium compounds are present in a total amount of from 0.01 wt% to 100 wt% based on the amount of organic photoconductive substance.

7. An electrophotographic photosensitive material as in claim 6, wherein said pyrylium compounds are present in a total amount of from 0.1 wt% to 30 wt% based on the amount of organic photoconductive substance.

8. An electrophotographic photosensitive material as in claim 2, wherein said amide compounds are present in a total amount of from 1 wt% to 100 wt% based on the amount of organic photoconductive substance.

9. An electrophotographic photosensitive material as in claim 8, wherein said amide compounds are present in a total amount of from 3 wt% to 30 wt% based on the amount of organic photoconductive substance.

10. An electrophotographic photosensitive material as in claim 1, wherein said material further contains a binder.

11. A electrophotographic photosensitive material as in claim 10, wherein said binder is present in an amount of from 30 to 180% by weight based on the weight of the organic photoconductive substance having a low molecular weight.

12. An electrophotographic photosensitive material as in claim 10, wherein said binder is present in an amount of from 1 to 50% by weight based on the weight of the organic photoconductive substance having a high molecular weight.

* * * * *